US005340047A

United States Patent [19]

Heller

[11] Patent Number: 5,340,047

[45] Date of Patent: Aug. 23, 1994

[54] TETHERED TELESCOPIC PAPER HOLDER

[76] Inventor: Eugene Heller, 18 Peachcroft Rd., Morristown, N.J. 07960

[21] Appl. No.: 604,636

[22] Filed: Oct. 29, 1990

[51] Int. Cl.[5] ..... A47K 10/22

[52] U.S. Cl. ..... 242/599.1

[58] Field of Search ..... 242/55.2, 55.53, 55.3, 242/55.42, 55.54

[56] References Cited

U.S. PATENT DOCUMENTS

| | | | |
|---|---|---|---|
| 2,253,664 | 8/1941 | Vigo | 242/55.53 |
| 2,313,776 | 3/1943 | Segal | 242/55.2 |
| 2,492,728 | 12/1949 | Balz | 242/55.2 |
| 2,500,514 | 3/1950 | Bozoti | 242/55.2 |
| 2,522,109 | 9/1950 | Foltis | 242/55.2 |
| 2,889,122 | 6/1959 | McConnell | 242/55.2 |
| 3,085,760 | 4/1963 | Belsky | 242/55.53 |
| 3,643,884 | 2/1972 | Curtin | 242/55.2 |
| 3,799,465 | 3/1974 | Erny | 242/55.2 |
| 3,963,190 | 6/1976 | Wilson | 242/55.53 |
| 4,015,788 | 4/1977 | O'Connor | 242/55.2 |
| 4,615,442 | 10/1986 | Beeken | 242/55.2 |
| 4,662,577 | 5/1987 | Lewis | 242/55.53 |

*Primary Examiner*—Daniel P. Stodola
*Assistant Examiner*—John Q. Nguyen
*Attorney, Agent, or Firm*—Behr & Adams

[57] ABSTRACT

A telescopic paper holder has a first and second cylindrical member each having an inside and outside end. The second cylindrical member is telescopically and slidably nested in the first cylindrical member. A spring can urge the first and second cylindrical members to extend axially. A tether is strung at the first and second cylindrical members to emerge from their outside ends. Thus the first and second cylindrical members can be compressed together by pulling in on the tether.

11 Claims, 1 Drawing Sheet

3
3
14
16
32
10
24
4
12
30
20
18
22
26
2
2
20
26
30
18
22
12
14
28
16
26
17
10
36
10
34
12
14
38
26
10
42
12
42
26
18
40
22

TETHERED TELESCOPIC PAPER HOLDER

BACKGROUND OF THE INVENTION

The present invention relates to telescopic paper holders and, in particular, to holders having a means for easily compressing and removing the paper holder.

A known holder has a pair of hollow telescopic cylinders with pintles at opposite ends. The holder can be inserted in the tube of a roll of toilet paper, compressed, and inserted by its pintles into bearing holes in a wall fixture. This known holder can include a helical compression spring that tends to expand the cylindrical members to keep them in the fixture. Ridges on the cylindrical members lock the members together. This type of holder is difficult to compress and remove when a spent cardboard tube remains and covers the ends of the holder.

Known toilet paper holders with telescopic cylinders or retractable pintles also include means for compressing the holder for easy removal. In some embodiments a wire loop mounted around the pintle can pivot and compress the holder to allow its removal. Other known devices employ various tabs or levers positioned around one end of a compressible paper holder. Again, depressing a tab or lever will compress the holder to allow easy removal. Various devices for easing removal of the paper holder and other structure relevant to paper holders are disclosed in U.S. Pat. Nos. 2,253,664; 2,313,776; 2,500,514; 2,522,109; 3,085,760; 4,015,788 and 4,662,577.

A disadvantage with paper holders of the foregoing type is the persistent difficulty in removing the holder. The removal lever used in some holders is intrusive. The lever consumes some of the very limited space around the wall fixture and may at times extend beyond the diameter of a partially depleted roll of paper. These levers can interfere with the unrolling of the paper.

Accordingly, there is a need for a paper holder that is simple, efficient, and has a relatively easy way for removing the holder without interfering with the nominal use of paper dispensing.

SUMMARY OF THE INVENTION

In accordance with the illustrative embodiments demonstrating features and advantages of the present invention, there is provided a telescopic paper holder including a first and second cylindrical member, each having an inside and outside end. The second cylindrical member is telescopically and slidably nested in the first cylindrical member. An extension means can urge the first and second cylindrical members to extend axially. The holder also includes a tether strung at the first and second cylindrical member to emerge from their outside ends. Thus the first and second cylindrical members can be compressed together by pulling in on their tether.

By employing such apparatus, a relatively simple and efficient holder is provided. This holder can be easily removed and the removal apparatus does not interfere with nominal usage as a paper dispenser. In a preferred embodiment, hollow cylinders having pintles at opposite ends are nested together telescopically. The cylinders are urged apart by an internal, helical compression spring until stopped by ridges on the cylindrical members. The preferred embodiment employs a cord threaded inside the two cylindrical members to emerges from opposite ends thereof. Preferably, the cord ends are knotted to prevent the cord from pulling out of the holder.

The preferred holder can be removed by the simple expedient of grasping each end of the cord and pulling them together. This motion compresses the holder and allows easy removal.

BRIEF DESCRIPTION OF THE DRAWINGS

The above brief description as well as other objects, features and advantages of the present invention will be more fully appreciated by reference to presently preferred but nonetheless illustrative embodiments in accordance with the present invention, when taken in conjunction with the accompanying drawings wherein.

DETAILED DESCRIPTION OF THE PREFERRED EMBODIMENTS

Figures 1, 2, 3, 4, 5:
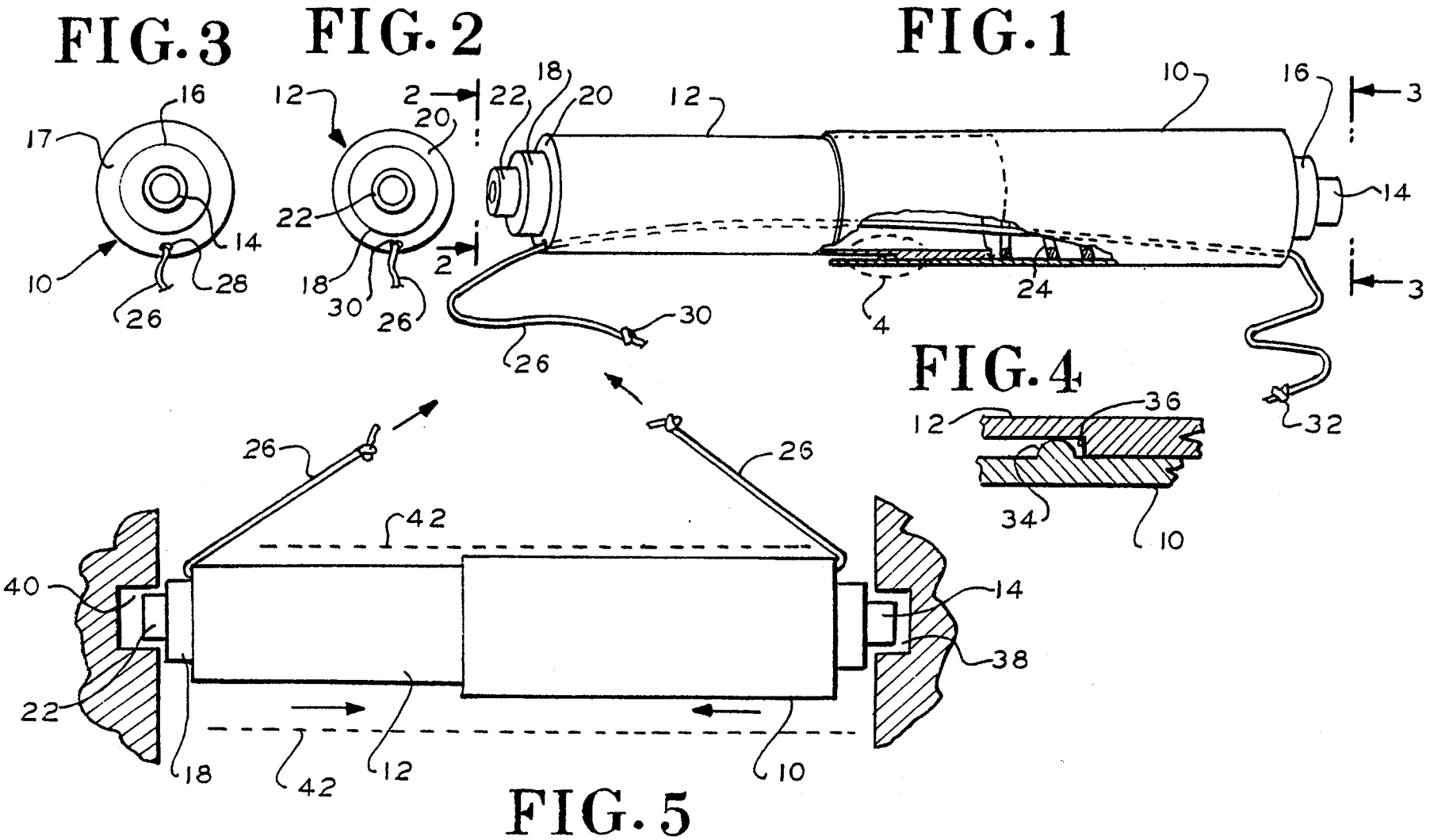
FIG. 1 is a side perspective view, partially in section, of a paper holder in accordance with the principles of the present invention.
FIG. 2 is an end view along lines 2—2 of the holder of FIG. 1.
FIG. 3 is an end view along lines 3—3 of the holder of FIG. 1.
FIG. 4 is a detailed view of area 4 of FIG. 1.
FIG. 5 is a side view of the holder of FIG. 1 being removed from a fixture.

Referring to FIGS. 1, 2 and 3, a telescopic paper holder has a first cylindrical member 10 and a second cylindrical member 12. Member 10 is a hollow cylinder open at its inside end and partially closed at its outside end to form a transverse end surface 17 supporting a roller 16, which in turn supports a cylindrical pintle 14.

Nested telescopically within member 10 is hollow cylindrical member 12. Member 12 also has a partially closed end forming a transverse end surface 20 supporting coaxial roller 18 and pintle 22.

An extension means is shown herein as helical compression spring 24 mounted between the inside end of member 12 and the interior of the transverse end 17 of member 10. Spring 24 tends to extend the member 12 from member 10, but this outward movement is restricted by the ridges in area 4 as described in further detail hereinafter.

Tether 26, a single line threaded through the inside of members 10 and 12, emerges from their outside ends through apertures 28 and 30 in transverse end surfaces 17 and 20, respectively. In this embodiment, apertures 28 and 30 have a greater inside diameter than the outside diameter of the cord 26 to allow cord movement. Cord 26 therefore has knots 30 and 32 at opposite ends to prevent the cord from pulling out. Instead of knots, the ends of cord 26 can be fitted with beads or other enlargements to prevent cord removal.

The length of tether 26 can be selected as desired. In some embodiments the tether may be in a form of two separate cords each secured to opposite ends of the holder. Alternatively, a single cord may be employed but fixed so it does not shift within the holder. For example, the cord may be glued in the aperture or knots tied on either side of each aperture. In some embodiments the tether may form a closed loop having sufficient slack that the cord can be grasped at the opposing ends of the holder. Furthermore, the cord can be formed of lines of various types and gauges, depending upon the desired strength, flexibility, weight, etc.

Referring to FIG. 4, cylindrical members 10 and 12 are shown with an external annular ridge 34 and internal annular ridge 36, respectively. The ridges 34 and 36 prevent members 10 and 12 from pulling apart.

To facilitate an understanding of the principles associated with the foregoing apparatus, its operation will be briefly described in connection with the illustration of FIG. 5. This figure shows a toilet paper fixture having bearing sockets 38 and 40 for receiving pintles 14 and 22, respectively. While the sockets 38 and 40 are shown sized to receive the pintles, the sockets can be larger and could receive the rollers 16 and 18 as well. In any event, the holder 10, 12 can be installed in the sockets of the fixture in the usual fashion. To compress cylinders 10, 12 the user may pull tether 26 together to assist installation.

When the toilet paper is depleted, the usual cardboard tube 42 remains around holder 10, 12. As shown herein, the tether 26 can be grasped at its ends and pulled in the direction indicated. Consequently, members 10 and 12 compress to retract the pintles 14 and 22 as illustrated. Continued retraction allows the removal of holder 10, 12.

The strings are relatively unobtrusive. They can conform to virtually any space existing between the fixture and the holder. The tether 26 does not rigidly extend outwardly to interfere with the manual dispensing of toilet paper. Furthermore, tether 26 will not restrict rotation of the holder.

It is to be appreciated that various modifications may be implement with respect to the above described preferred embodiment. For example, the cylindrical members can be formed of metal, plastics of various types or other material depending upon the desired strength, weight, rigidity etc. Also, the telescopic movement can be facilitated by splines and stops of various types. Also, instead of the cylindrical members having approximately the same size, in some embodiments the pintle or the roller will retract by itself, leaving the majority of the holder having no moving parts. In the latter event, the tether is simply routed through the moving pintle. Also, while a combination of pintle and roller is shogun at each end of the holder, in some embodiments a single pintle or multiple rollers may be employed.

Obviously many modifications and variations of the present invention are possible in light of the above teachings. It is therefore to be understood that within the scope of the appended claims, the invention may be practiced otherwise than as specifically described.

I claim:

1. A telescopic paper holder comprising:

a first cylindrical member having an inside and an outside end;

a second cylindrical member having an inside and an outside end and being telescopically and slidably nested in said first cylindrical member;

extension means for urging said first and second cylindrical members to extend axially;

a flexible tether strung about said first and second cylindrical members to emerge from their outside ends, said tether being exposed an amount to allow manual grasping of said tether about the outside ends of said first and second cylindrical members, so that said first and second cylindrical members can be compressed together by pulling said tether in opposing directions parallel to said first and second cylindrical members.

2. A telescopic paper holder according to claim 1 wherein said first and second cylindrical members are hollow and have apertures at their outside ends for embracing said tether.

3. A telescopic paper holder according to claim 2 wherein said tether comprises:

a single line strung inside said first and second cylindrical members and out through their apertures.

4. A telescopic paper holder according to claim 3 wherein said line is loosely fitted in said first and second cylindrical members and is free to shift through their apertures.

5. A telescopic paper holder according to claim 4 wherein said line is a flexible cord longer than the assembled length of said first and second cylindrical members.

6. A telescopic paper holder according to claim 5 wherein said flexible cord has two ends enlarged to prevent passage through the apertures of said first and second cylindrical members.

7. A telescopic paper holder according to claim 5 wherein said flexible cord is a string with a pair of knotted ends.

8. A telescopic paper holder according to claim 5 wherein the outside end of each of said first and second cylindrical members comprises an axially aligned pintle projecting from a transverse end surface pierced by said aperture.

9. A telescopic paper holder according to claim 5 wherein the outside ends of each of said first and second cylindrical members comprise an axially aligned pintle coaxially projecting from an integral coaxial cylindrical projection which projects from a transverse end surface pierced by said aperture.

10. A telescopic paper holder according to claim 9 wherein said flexible cord is a string with a pair of knotted ends.

11. A telescopic paper holder according to claim 10 wherein said first and second cylindrical members have an internal and an external annular ridge, respectively, each located to the inside of the other to keep said first and second cylindrical members together, said extension means being a helical compression spring mounted between the outside end of said first cylindrical member and the inside end of said second cylindrical means.

* * * * *